US008177592B2

(12) United States Patent
Kamio

(10) Patent No.: US 8,177,592 B2
(45) Date of Patent: May 15, 2012

(54) PERSONAL WATERCRAFT

(75) Inventor: Kunihiko Kamio, Kobe (JP)

(73) Assignee: Kawasaki Jukogyo Kabuskihi Kaisha, Kobe-shi (JP)

( * ) Notice: Subject to any disclaimer, the term of this patent is extended or adjusted under 35 U.S.C. 154(b) by 148 days.

(21) Appl. No.: 12/754,540

(22) Filed: Apr. 5, 2010

(65) Prior Publication Data

US 2011/0244737 A1 Oct. 6, 2011

(51) Int. Cl.
*B63H 11/11* (2006.01)

(52) U.S. Cl. ..... 440/41; 114/145 R

(58) Field of Classification Search ..... 114/144 R, 114/145 R, 146; 440/40, 41, 42
See application file for complete search history.

(56) References Cited

U.S. PATENT DOCUMENTS 5,813,357 A * 9/1998 Watson ..... 114/145 R
6,350,163 B1 * 2/2002 Fujimoto ..... 440/41
6,691,634 B2 2/2004 Fritchle
7,007,621 B1 3/2006 Bootes
7,052,338 B2 * 5/2006 Morvillo ..... 440/41

FOREIGN PATENT DOCUMENTS

JP 2004196041 7/2004

* cited by examiner

*Primary Examiner* — Lars A Olson
(74) *Attorney, Agent, or Firm* — Alleman Hall McCoy Russell & Tuttle LLP

(57) ABSTRACT

A personal watercraft comprises a water jet pump configured to be driven by an engine to generate a rearward water jet, a reverse bucket mounted at a periphery of the water jet pump and movable between a forward driving position and a reverse driving position, a driving power operation member configured to control an engine driving power, a reverse driving operation member configured to change a position of the reverse bucket from the forward driving position to the reverse driving position, and a deceleration operation member, wherein the reverse bucket is in the forward driving position when the deceleration operation member and the reverse driving operation member are not operated, and the reverse bucket is in a deceleration position between the forward driving position and the reverse driving position when the deceleration operation member has been operated and the reverse driving operation member is not operated.

14 Claims, 11 Drawing Sheets

PERSONAL WATERCRAFT

BACKGROUND OF THE INVENTION

1. Field of the Invention

The present invention relates to a personal watercraft (PWC) which is configured to generate a propulsive force as a reaction of a water jet. More particularly, the present invention relates to a personal watercraft configured to change a direction of a water jet to switch between forward driving and reverse driving.

2. Description of the Related Art

A personal watercraft includes a water jet pump configured to be driven by an engine to generate a rearward water jet and a movable reverse bucket provided at the periphery of the water jet pump. When the reverse bucket is in a forward driving position in which the reverse bucket permits the rearward water jet being ejected from the water jet pump, the personal watercraft can drive forward. On the other hand, when the reverse bucket is in a reverse driving position in which the reverse bucket changes the direction of the water jet being ejected from the water jet pump from a rearward direction to a forward direction, the personal watercraft can drive reversely. The personal watercraft includes a reverse driving operation member operated by the rider. The reverse bucket is configured to move from the forward driving position to the reverse driving position in response to the rider's operation of the reverse driving operation member.

The personal watercraft includes a driving power operation member which is operated by the rider to control an engine driving power. When the driving power operation member is operated by the rider to increase the engine driving power, the water jet is accelerated, causing the watercraft to be accelerated. When the driving power operation member is not operated, the water jet slows, and a body tilts forward. Thereby, a body resistance increases, and the watercraft is decelerated naturally.

SUMMARY OF THE INVENTION

According to the present invention, a personal watercraft comprises an engine mounted in a body; a water jet pump configured to be driven by the engine to generate a rearward water jet to apply a propulsive force to the body; a reverse bucket mounted at a periphery of the water jet pump and movable between a forward driving position and a reverse driving position, the reverse bucket being configured to permit the rearward water jet in the forward driving position and to direct the water jet in a forward direction in the reverse driving position; a driving power operation member configured to be operated by a rider to control a driving power of the engine; a reverse driving operation member configured to be operated by the rider to change a position of the reverse bucket from the forward driving position to the reverse driving position; and a deceleration operation member configured to be operated by the rider; wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated.

In accordance with such a configuration, the propulsive force applied to the watercraft is flexibly adjustable by operating the driving power operation member, and a decelerative effect of water resistance is produced when the driving power operation member is not operated during driving of the watercraft. In addition, when the deceleration operation member is operated by the rider, the reverse bucket moves to the deceleration position between the forward driving position and the reverse driving position, thereby changing the direction of the water jet being ejected from the water jet pump. As the resulting reaction, an additional decelerative effect is produced. Since the rider can select a normal decelerative effect or an enhanced decelerative effect according to the rider's preference, maneuverability of the watercraft is improved.

The above and further objects and features of the invention will more fully be apparent from the following detailed description with reference to the accompanying drawings.

BRIEF DESCRIPTION OF THE DRAWINGS

FIGS. 3A to 3C are plan views showing a reverse driving operation member and a deceleration operation member of FIG. 2, and their adjacent members, in which FIG. 3A shows a state where the reverse driving operation member and the deceleration operation member are not operated, FIG. 3B shows a state where the reverse driving operation member is operated, and FIG. 3C shows a state where the deceleration operation member is operated and the reverse driving operation member is not operated.

FIGS. 4A to 4C are partial cross-sectional views of the watercraft of FIG. 1 as viewed from the left side, showing positions of the reverse bucket according to the operation state of the reverse driving operation member and the operation state of the deceleration operation member of FIG. 2, in which FIG. 4A shows a state where the reverse bucket is in a forward driving position according to the operation state shown in FIG. 3A, FIG. 4B shows a state where the reverse bucket is in a reverse driving position according to the operation state shown in FIG. 3B, and FIG. 4C shows a state where the reverse bucket is in a deceleration position according to the operation state shown in FIG. 3C.

DETAILED DESCRIPTION OF THE PREFERRED EMBODIMENTS

Hereinafter, embodiments of the present invention will be described with reference to the drawings. As used herein, the term "directions" refers to directions from the perspective of a rider straddling a personal watercraft.

[Embodiment 1]

Figure 1:
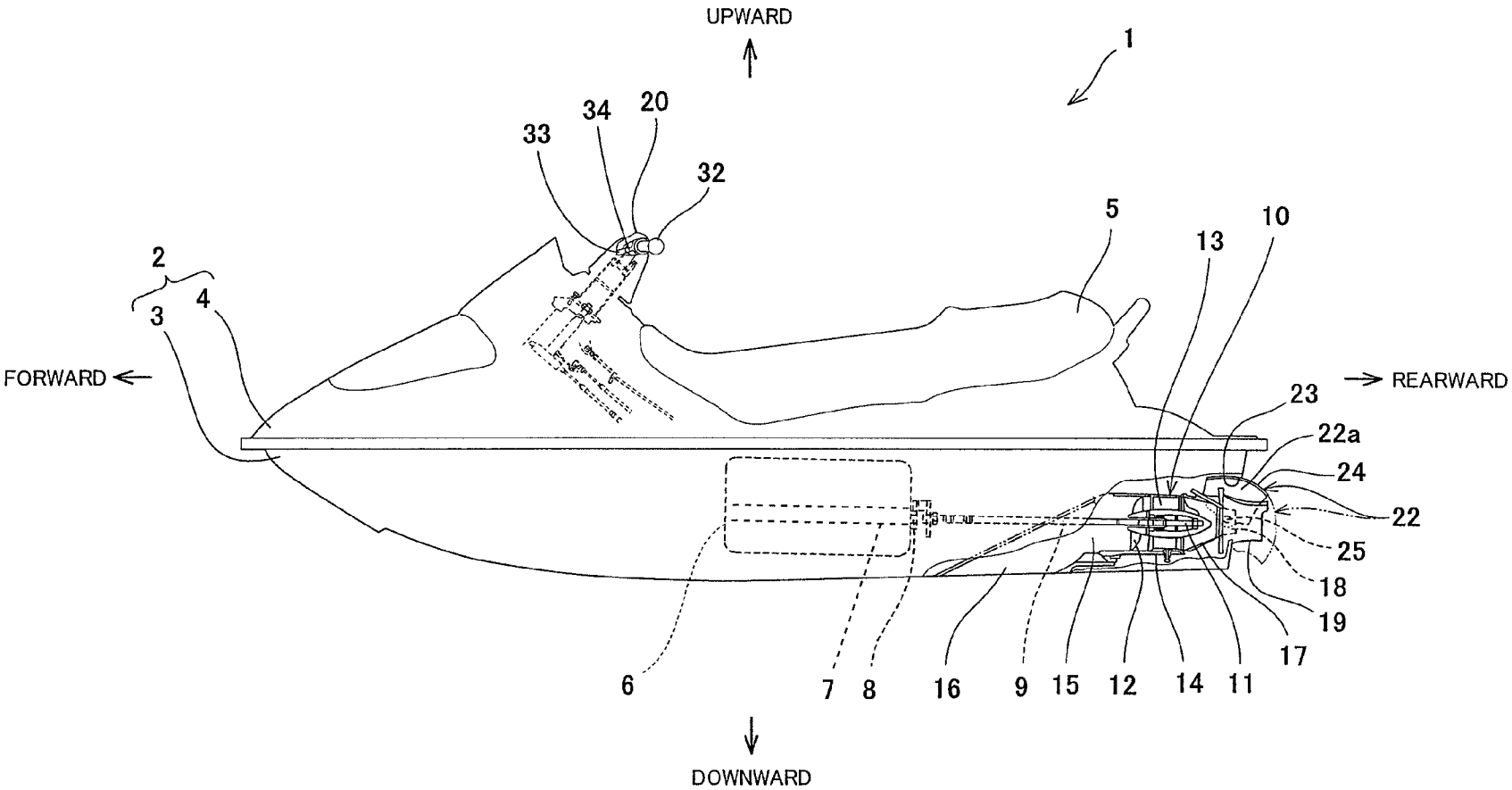
FIG. 1 is a left side view of a personal watercraft according to Embodiment 1 of the present invention, a part of which is cut away.

FIG. 1 is a left side view of a personal watercraft according to Embodiment 1 of the present invention, a part of which is cut away. As shown in FIG. 1, a watercraft 1 includes a body 2 including a hull 3 and a deck 4 covering the hull 3 from above. A straddle seat 5 is mounted over the upper surface of the deck 4. An engine 6 is accommodated into an engine room defined by the hull 3 and the deck 4 below the seat 5 such that a crankshaft 7 extends in a longitudinal direction of the watercraft 1. The output end of the crankshaft 7 is coupled to a pump shaft 11 of a water jet pump 10 disposed at the rear portion of the body 2 via a coupling device 8 and a propeller shaft 9. The water jet pump 10 includes an impeller 12 attached on the pump shaft 11, fairing vanes 13 provided behind the impeller 12, and a tubular pump casing 14 covering the outer periphery of the impeller 12. The pump casing 14 is connected to a water intake 16 provided on the bottom surface of the hull 3 of the body 2 via a water passage 15, and is coupled to a pump nozzle 17 provided at the rear portion of the body 2. The pump nozzle 17 has a diameter reducing in a rearward direction. The pump nozzle 17 has an outlet port 18 at a rear end thereof. The outlet port 18 is coupled to a steering nozzle 19 which is pivotable to the right or to the left.

Upon the engine 6 starting running, the rotation of the crankshaft 7 is transmitted to the pump shaft 11, causing the water jet pump 10 to operate. The impeller 12 rotates according to a driving power of the engine 6, to pressurize and accelerate the water sucked through the water intake 16, thereby generating a water jet directed rearward. The water jet is guided by the fairing vanes 13 and is ejected rearward from the outlet port 18 through the steering nozzle 19. As the resulting reaction, the watercraft 1 gains a propulsive force for driving the body 2.

A handle 20 is provided in front of the seat 5 and includes a pair of right and left grips which are gripped by the rider. The handle 20 is coupled to the steering nozzle 19 via a steering cable 21 (see FIG. 2). When the handle 20 is rotated to the right or to the left by the rider, the steering nozzle 19 is pivoted to the left or to the right. Thereby, a rightward and leftward component is added to the direction of the water jet being ejected through the steering nozzle 19, enabling the watercraft 1 to turn in a desired direction.

A bowl-shaped reverse bucket 22 is mounted at the periphery of the water jet pump 10. Hereinafter, the surface of the reverse bucket 22, forming a space 22*a*, is referred to as an inner surface 23, and an opposite surface of the inner surface 23 is referred to as an outer surface 24. The inner surface 23 of the reverse bucket 22 is curved and faces the steering nozzle 19. The reverse bucket 22 is pivotable with respect to the body 2 around a pivot shaft 25 extending horizontally in a rightward and leftward direction. To be more specific, the reverse bucket 22 is pivotable between a forward driving position (indicated by a solid line) in which the reverse bucket 22 is retracted and in an up position and a reverse driving position (indicated by a two-dotted line) in which the reverse bucket 22 extends in a downward direction and is in a down position. The reverse bucket 22 is pivoted clockwise in FIGS. 4A to 4C, to move from the forward driving position to the reverse driving position. As explained in detail later, when the reverse bucket 22 is in the forward driving position, the rearward water jet being ejected from the water jet pump 10 is permitted, enabling the watercraft 1 to drive forward, while when the reverse bucket 22 is in the reverse driving position, the direction of the water jet being ejected from the water jet pump 10 is changed from rearward to forward, enabling the watercraft 1 to drive reversely.

Figure 2:
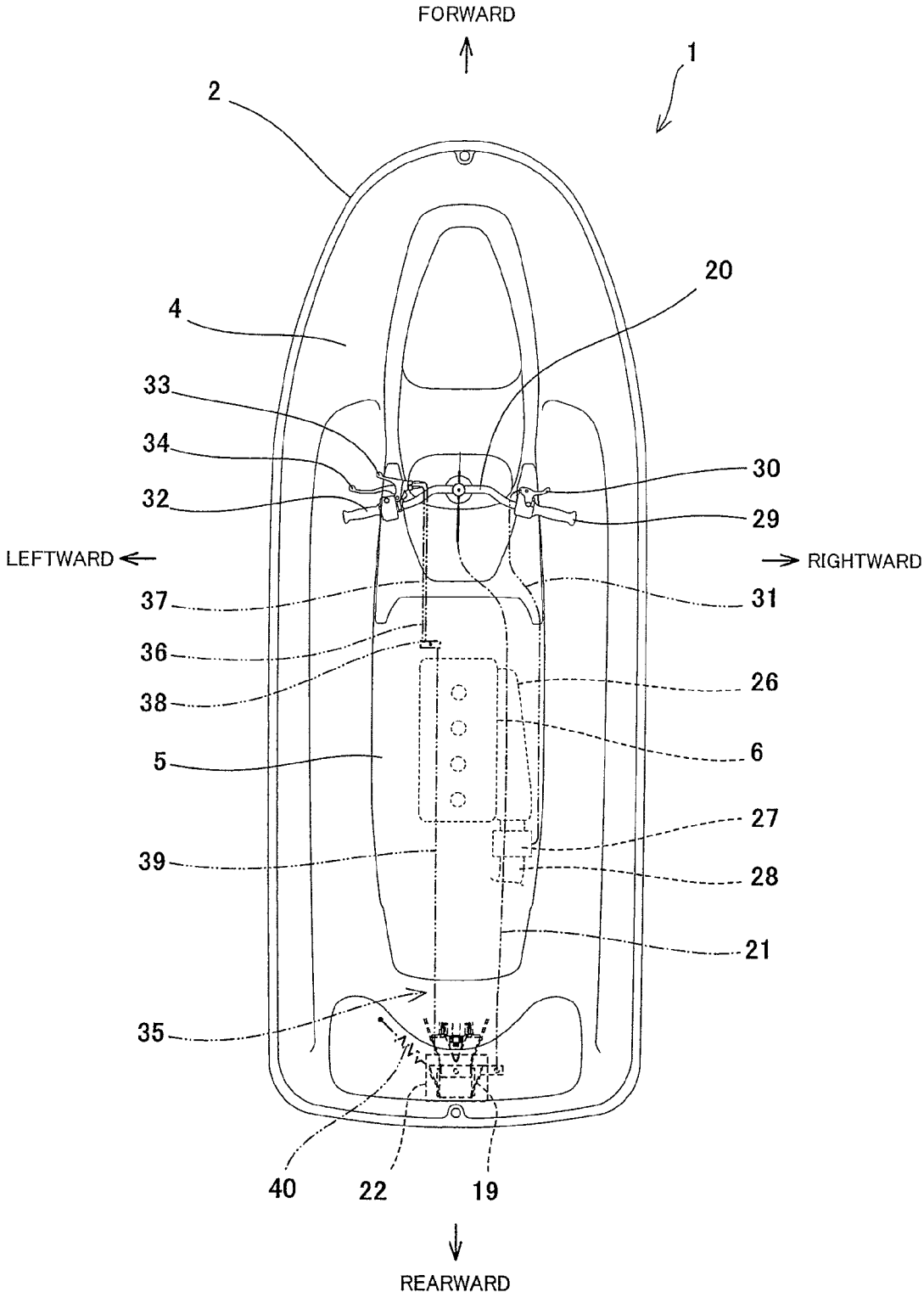
FIG. 2 is a plan view of the personal watercraft of FIG. 1.

FIG. 2 is a plan view of the watercraft 1 of FIG. 1. As shown in FIG. 2, an intake manifold 26 extending in the longitudinal direction is coupled to the right side portion of the engine 6, and the rear end of the intake manifold 26 is coupled to a throttle device 27. The rear end portion of the throttle device 27 is coupled to an air box (not shown) via a duct 28. Air is delivered from the air box via the throttle device 27 and the intake manifold 26 and is supplied to cylinders of the engine 6.

A driving power operation member 30 is attached to the right grip 29 of the handle 20. In this embodiment, the driving power operation member 30 is a throttle lever and is pivotally attached to the right grip 29 in front of and adjacent to the right grip 29. The driving power operation member 30 is movable between a first position and a second position. In a state where the driving power operation member 30 is not operated, the driving power operation member 30 is in the first position where the driving power operation member 30 is most distant from the right grip 29. When the driving power operation member 30 is pulled toward the rider, it is moved to the second position where the driving power operation member 30 is closest to the right grip 29.

In this embodiment, the driving power operation member 30 is mechanically coupled to the throttle device 27 via the throttle cable 31. The throttle device 27 is operable to change an air-intake amount according to the position of the driving power operation member 30. This makes it possible to change the speed of the water jet being ejected from the water jet pump 10 driven by the engine 6, and thereby change a propulsive force applied to the body 2 of the watercraft 1.

When the driving power operation member 30 is moved to the second position, the driving power of the engine 6 and hence the propulsive force increase. Under this condition, the watercraft 1 planes on the water surface while the body 2 is slightly tilted in a rearward direction, i.e., the fore portion of the body 2 is moving up. When the driving power operation member 30 is returned to the first position during driving of the watercraft 1, the driving power of the engine 6 decreases and the propulsive force is lost. Under this condition, the body 2 tilts forward and the body resistance increases. By utilizing a decelerative effect of the water resistance, the watercraft 1 is decelerated.

The left grip 32 of the handle 20 is attached with a reverse driving operation member 33 and a deceleration operation member 34. In this embodiment, the reverse driving operation member 33 and the deceleration operation member 34 are lever-type operation members (deceleration operation lever and reverse driving operation lever). The reverse driving operation member 33 and the deceleration operation member 34 are pivotally attached to the left grip 32. The reverse driving operation member 33 and the deceleration operation member 34 are coupled to the reverse bucket 22 via a coupling mechanism 35. The position of the reverse bucket 22 is changed according to the position of the reverse driving operation member 33 and the position of the deceleration operation member 34. In the watercraft 1, the reverse bucket 22 moves in association with the operation of the deceleration operation member 34, to change the direction of the water jet being ejected from the water jet pump 10. As the resulting reaction of the water jet, the watercraft 1 can gain an additional decelerative effect.

The coupling mechanism 35 may include wires configured to mechanically couple the reverse driving operation member and the deceleration operation member to the reverse bucket, as described hereinafter. The reverse driving operation member 33 is coupled to one end portion of a reverse driving cable 36. The deceleration operation member 34 is coupled to one end portion of a deceleration cable 37. The opposite end portions of the cables 36 and 37 are coupled to a coupling member 38. The coupling member 38 is coupled to the reverse bucket 22 via a bucket cable 39. Upon the reverse driving cable 36 and the deceleration cable 37 being pulled forward, the coupling member 38 pushes out the bucket cable 39 in a rearward direction. The coupling member 38 is formed by, for example, a seesaw-like lever which is pivotable around the pivot at its center portion. The reverse driving cable 36 and the deceleration cable 37 are coupled to the one end portion of the coupling member 38, and the bucket cable 39 is coupled to the opposite end portion of the coupling member 38. The deceleration cable 37 is coupled to the coupling member 38 in a location that is more distant from the pivot of the coupling member 38 than the location at which the reverse driving cable 36 is coupled to the coupling member 38. The reverse driving cable 36, the deceleration cable 37 and the bucket cable 39 are push-pull cables. A biasing member 40 is provided between the reverse bucket 22 and the body 2. The biasing member 40 applies a force to place the reverse bucket 22 in the forward driving position. The biasing member 40 includes, for example, a coil spring, etc. Alternatively, another biasing member may be provided between the coupling member 38 and the body 2 to apply a force to allow the reverse driving cable 36 and the deceleration cable 37 to be pulled in a rearward direction and the bucket cable 39 to be pulled in a forward direction.

Figure 3A:
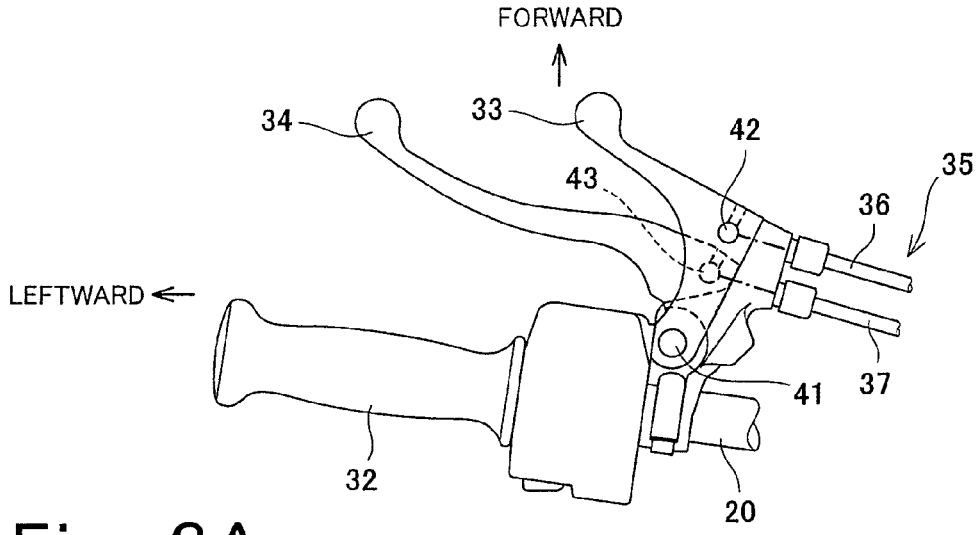
Figure 3B:
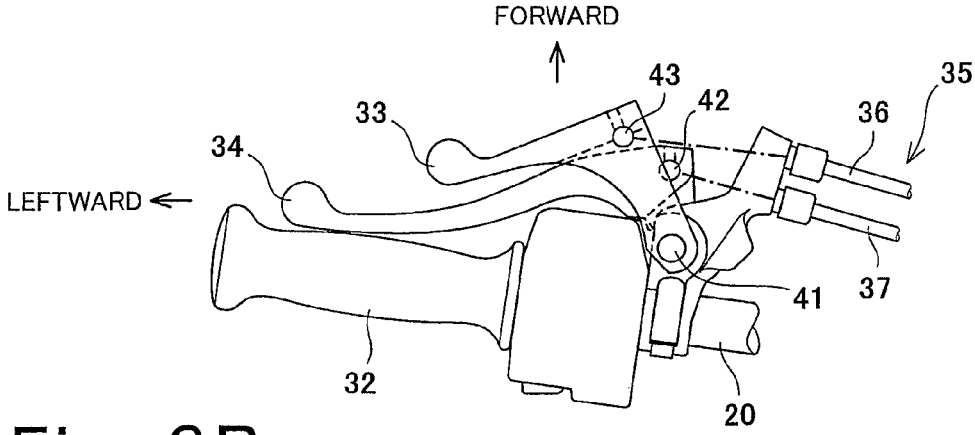
Figure 3C:
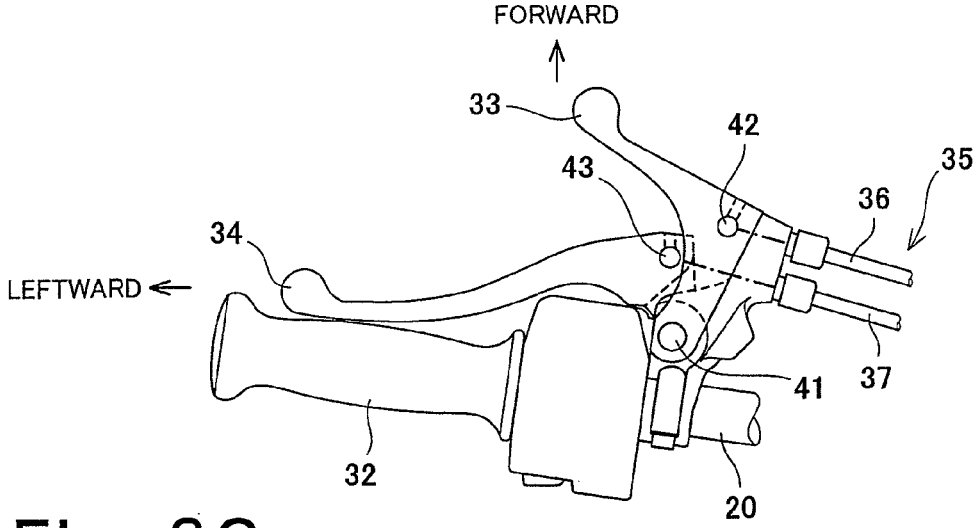

FIGS. 3A to 3C are plan views showing the reverse driving operation member 33 and the deceleration operation member 34 of FIG. 2, and their adjacent members. As shown in FIGS. 3A to 3C, a common pivot 41 is provided at the base end portion of the left grip 32 to extend substantially vertically. The one end portion of the reverse driving operation member 33 and the one end portion of the deceleration operation member 34 are supported by the common pivot 41 such that the members 33 and 34 are rotatable around the common pivot 41. In this structure, the reverse driving operation member 33 and the deceleration operation member 34 are pivotable around a common axis within the same flat plane. The reverse driving operation member 33 and the deceleration operation member 34 extend in a substantially rightward and leftward direction. The deceleration operation member 34 is pivotally provided in front of and adjacent to the left grip 32, and the reverse driving operation member 33 is pivotally provided in front of and adjacent to the deceleration operation member 34. The reverse driving operation member 33 has at one end portion thereof, a cable fixing portion 42 for fixing the one end portion of the reverse driving cable 36. The deceleration operation member 34 has at one end portion thereof a cable fixing portion 43 for fixing the one end portion of the deceleration cable 37.

The deceleration operation member 34 is pivotable between a first position (see FIG. 3A) in which the opposite end portion of the deceleration operation member 34 is distant from the left grip 32 and a second position (see FIGS. 3B and 3C) in which the opposite end portion of the deceleration operation member 34 is closer to the left grip 32. The deceleration operation member 34 is placed in the first position by a force in a state where the deceleration operation member 34 is not operated by the rider, and is movable to the second position by the pull-operation of the rider's left hand. The same occurs in the reverse driving operation member 33. FIGS. 3A and 3C show the state where the reverse driving operation member 33 is not operated by the rider and placed in the first position, and FIG. 3B shows a state where the reverse driving operation member 33 is pulled by the rider and moved to the second position.

As shown in FIG. 3B, the reverse driving operation member 33 is disposed in front of and adjacent to the deceleration operation member 34. The reverse driving operation member 33 and the deceleration operation member 34 are pivotable within substantially the same flat plane. Since the reverse driving operation member 33 is positioned in front of the deceleration operation member 34, the deceleration operation member 34 is pushed by and moves together with the reverse driving operation member 33 when the reverse driving operation member 33 is pulled by the rider.

Figure 4A:
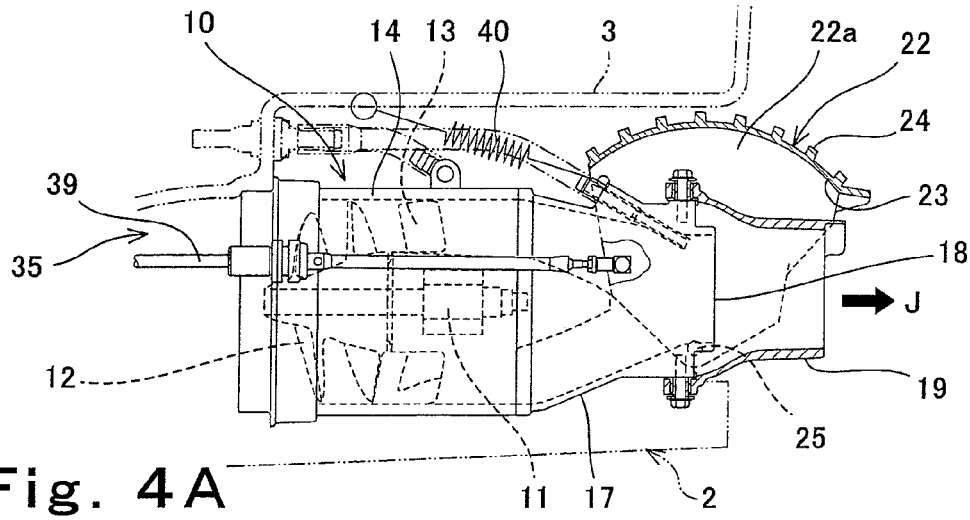

FIG. 4A shows the position of the reverse bucket 22 in the state where the reverse driving operation member 33 and the deceleration operation member 34 are not operated and are in the first position as shown in FIG. 3A. In this state, the reverse bucket 22 is subjected to the force applied from the biasing member 40 and placed in the forward driving position in which the reverse bucket 22 is retracted and positioned above the steering nozzle 19. In this case, the water jet being ejected rearward through the steering nozzle 19 is not blocked by the reverse bucket 22, and a rearward water jet J is permitted. As the resulting reaction, the watercraft 1 obtains a forward propulsive force and drives forward.

Figure 4B:
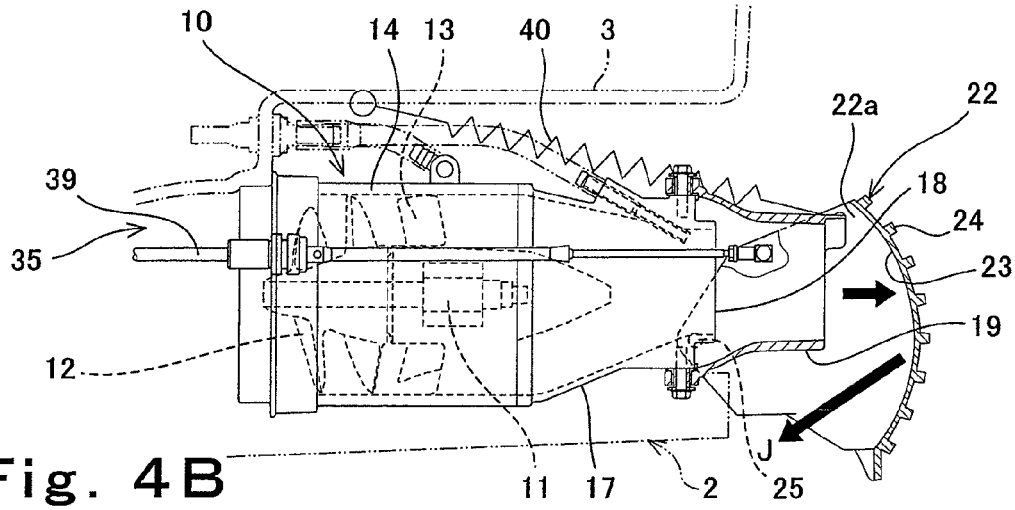

FIG. 4B shows the position of the reverse bucket 22 in the state where the reverse driving operation member 33 is operated and thereby both the reverse driving operation member 33 and the deceleration operation member 34 are moved to the second position. In this state, the cable fixing portion 42 of the reverse driving operation member 33 and the cable fixing portion 43 of the deceleration operation member 34 move to the left, and the reverse driving cable 44 and the deceleration cable 45 which are fixed to the cable fixing portions 42 and 43, respectively are pulled in a forward direction. Thereby, the bucket cable 39 is pushed out in a rearward direction, causing the reverse bucket 22 to rotate clockwise in FIG. 4 against the force applied by the biasing member 40. As a result, the reverse bucket 22 moves from the forward driving position to the reverse driving position.

When the reverse bucket 22 is in the reverse driving position, the space 22*a* of the reverse bucket 22 is positioned behind the steering nozzle 19 to surround the rear portion of the steering nozzle 19. To be more specific, the rear portion of the steering nozzle 19 is covered with the space 22*a* of the reverse bucket 22, and the rear end opening of the steering nozzle 19 overlaps with a part of the reverse bucket 22 as viewed from the rear. The inner surface 23 of the reverse bucket 22 extends downward farther than the lower end portion of the rear end opening of the steering nozzle 19. Under this condition, the water jet being ejected rearward through the steering nozzle 19 collides against the inner surface 23 of the reverse bucket 22, and thereby is directed forward. The water jet is easily guided in a forward direction by the portion of the inner surface 23 of the reverse bucket 22 which extends downward father than the lower end portion of the steering nozzle 19. As the resulting reaction of the forward water jet, the watercraft 1 gains a rearward propulsive force and drives in a reverse direction.

Figure 4C:
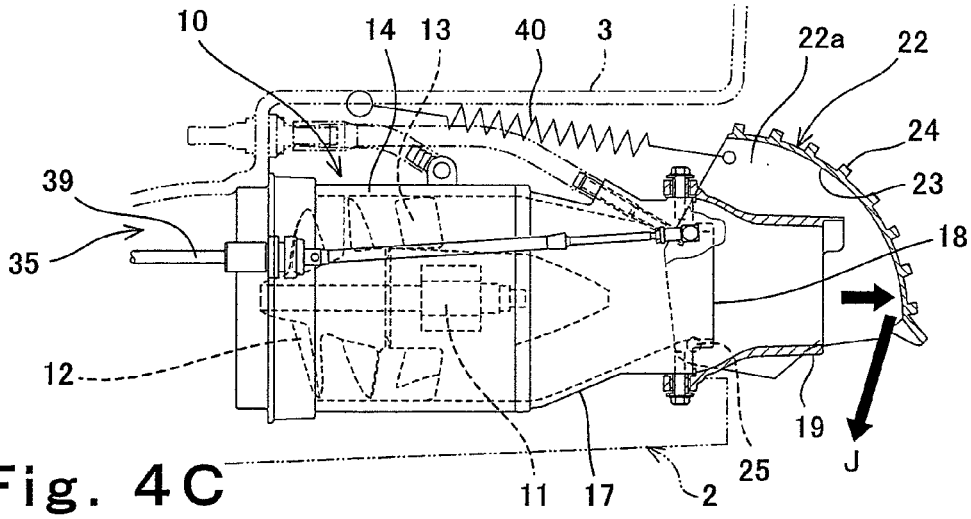

FIG. 4C shows the position of the reverse bucket 22 in the state where the deceleration operation member 34 is operated and is in the second position and the reverse driving operation member 33 is not operated and is in the first position, as shown in FIG. 3C. In this state, only the deceleration cable 37 coupled to the deceleration operation member 34 is pulled in a forward direction. In this case, the amount of the push-out of the bucket cable 39 in a rearward direction is smaller than when the reverse driving cable 36 and the deceleration cable 37 are both pulled. As a result, the reverse bucket 22 rotates clockwise in FIG. 4 to a certain extent from the forward driving position against the force applied by the biasing member 40 but does not reach the reverse driving position. In other words, the reverse bucket 22 stops in an intermediate position between the forward driving position and the reverse driving position. Hereinafter, the position of the reverse bucket 22 resulting from the operation of only the deceleration operation member 34 is referred to as a "deceleration position."

When the reverse bucket 22 is in the deceleration position, the rear portion of the steering nozzle 19 is covered with the space 22*a* of the reverse bucket 22. To be more specific, the lower end portion of the rear end opening of steering nozzle 19 substantially conforms in vertical position to the rear lower end portion of the reverse bucket 22 in the deceleration position. In this case, the water jet J being ejected from the water jet pump 10 collides against the inner surface 23 of the reverse bucket 22, and changes its direction. The resulting water jet J contains a forward component smaller than the forward component of the water jet in the state where the reverse bucket 22 is in the reverse driving position.

In a case where the rider wishes to produce an decelerative effect in addition to the decelerative effect of the water resistance during forward driving of the watercraft 1, the rider operates the deceleration operation member 34 to generate a reaction of the water jet containing a forward component, thereby applying a propulsive force containing a rearward component to the watercraft 1. In addition, the reaction of the water jet containing a downward component might assist the forward tilting of the watercraft 1, thereby increasing the body resistance. Based on such rearward propulsive force and the forward tilting assist, the watercraft 1 being driving in a forward direction would be able to gain an additional decelerative effect.

As should be readily appreciated from the above, the rider can determine whether or not to produce an additional decelerative effect by determining whether or not to operate the deceleration operation member 34. Therefore, when the rider wishes to decelerate the watercraft 1 during forward driving, the rider can select using a decelerative effect of only the body resistance, or using an additional decelerative effect to enhance a deceleration capability of the watercraft. As a result, maneuverability of the watercraft 1 is improved.

As shown in FIG. 3A, the length of the deceleration operation member 34 is larger than the length of the reverse driving operation member 33. The opposite end portion of the deceleration operation member 34 is located outward (leftward) relative to the opposite end portion of the reverse driving operation member 33. In this arrangement, the rider gripping the left grip 32 can relatively easily operate the deceleration operation member 34 which is positioned closer to the left grip 32 and has a relatively large length. Therefore, the rider can operate the deceleration operation member 34 quickly and easily, when the rider wishes to decelerate the watercraft 1 during driving. Since the reverse driving operation member 33 is relatively short (e.g., shorter than deceleration operation member 34), a chance that a fourth finger and a fifth finger of the left hand of the rider engage with the reverse driving operation member 33 is reduced. In other words, the reverse driving operation member 33 is not easily operated without the rider's intention to operate the reverse driving operation member 33. Therefore, in the configuration in which two different members 33 and 34 are arranged adjacent each other on the left grip 32 gripped by the left hand of the rider, a chance that these members 33 and 34 are operated inadvertently is reduced. Thus, in accordance with the structures and arrangement of the reverse driving operation member 33 and the deceleration operation member 34 of this embodiment, maneuverability of the watercraft 1 is further improved. Since the operation members 33 and 34 are arranged adjacent each other in the vicinity of left grip 32, the handle 20 and its adjacent members are simplified. Furthermore, since the operation members 33 and 34 are pivotable within substantially the same flat plane, i.e., they are arranged in substantially the same position as described above, the handle 20 and its adjacent members are compactly configured.

The magnitude of the decelerative effect produced using the reverse bucket 22 depends on the speed of the water jet being ejected from the water jet pump 10. When the rider intentionally operates the deceleration operation member 34, the driving power operation member 30 with which an acceleration request or a high-speed driving request is input should be unoperated. In this case, it is difficult to generate a high-speed water jet for the deceleration. Hereinafter, a configuration for improving the decelerative effect produced using the reverse bucket 22 will be described.

Figure 5:
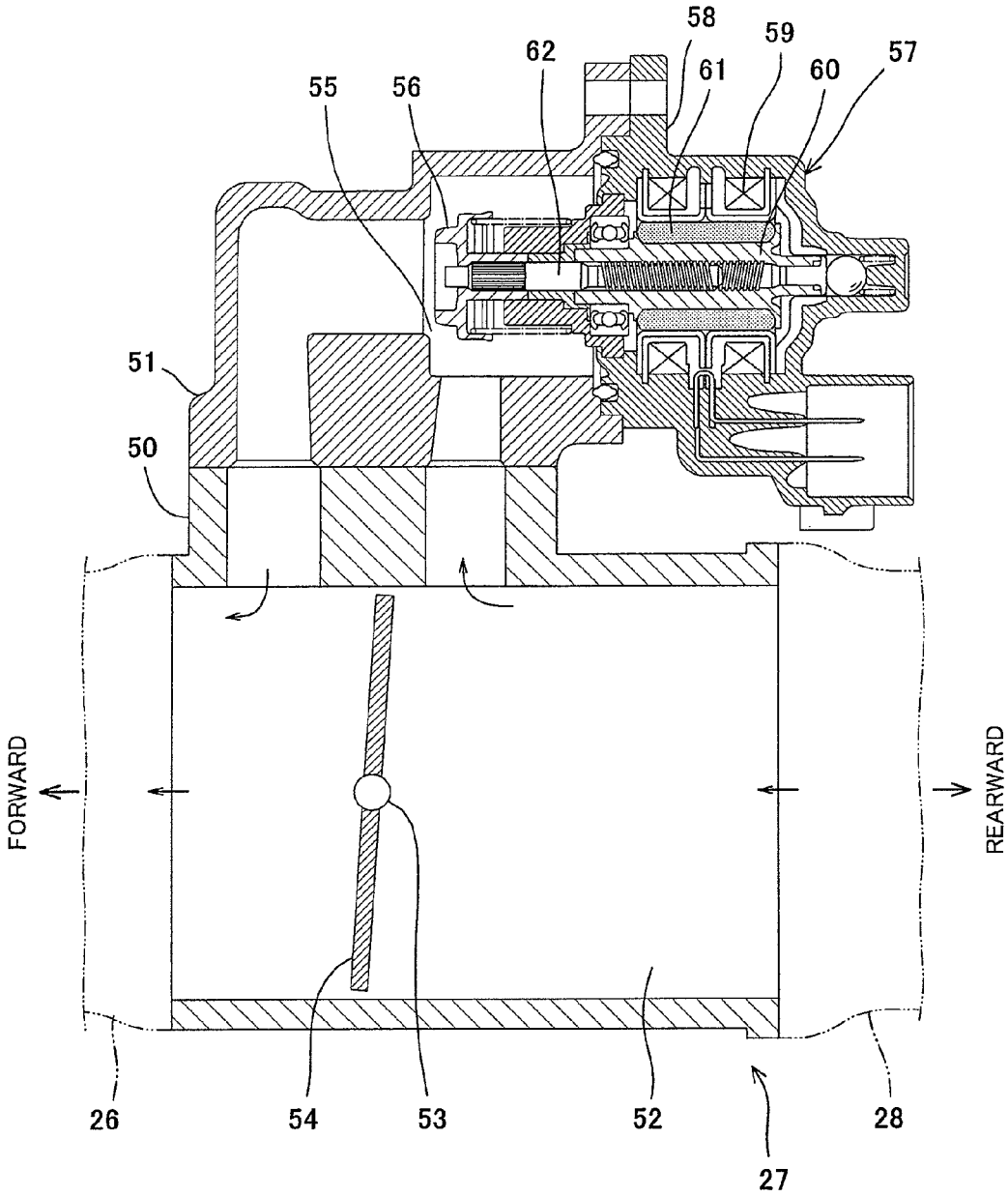
FIG. 5 is a cross-sectional view of a throttle device of FIG. 2.

FIG. 5 is a cross-sectional view showing a configuration of the throttle device 27 of FIG. 2. As shown in FIG. 5, the throttle device 27 of this embodiment includes a main throttle body 50 and an idling control body 51. The main throttle body 50 forms an air-intake passage 52 into which air from the duct 28 flows. The air is delivered from the air-intake passage 52 to the intake manifold 26. A throttle shaft 53 is rotatably inserted into the main throttle body 50. A disc-shaped throttle valve 54 is fixed to the throttle shaft 53 and is provided within the air-intake passage 52. The throttle shaft 53 is coupled to the driving power operation member 30 (see FIG. 2) via a throttle cable 31 (see FIG. 2). When the driving power operation member 30 is operated by the rider, the throttle shaft 53 rotates. When the throttle shaft 53 rotates, the throttle valve 54 rotates together, changing the opening degree of the air-intake passage 52. When the driving power operation member 30 is in the first position, the throttle valve 54 is in a fully-closed position, while when the driving power operation member 30 is in the second position, the throttle valve 54 is in a fully-open position.

The idling control body 51 forms a bypass passage 55 for allowing air flowing into the air-intake passage 52 to bypass the throttle valve 54 and flow out from the air-intake passage 52. A bypass valve 56 is provided in the bypass passage 55 to increase or decrease a passage cross-sectional area of the bypass passage 55. The idling control body 51 is provided with a bypass valve drive device 57 configured to drive the bypass valve 56. The bypass valve drive device 57 includes a stator 58 forming an outer tube. An armature coil 59 is mounted to the inner peripheral surface of the stator 58. A cylindrical rotor 60 is mounted to the inner peripheral side of the armature coil 59 such that the rotor 60 is rotatably supported by the stator 58. A permanent magnet 61 is mounted to the outer peripheral surface of the rotor 60 to be opposite to the armature coil 59. A drive shaft 62 is inserted into the rotor 60. The drive shaft 62 is threadedly engaged with the rotor 60 and is unable to rotate. The bypass valve 56 is spline-coupled to the tip end portion of the drive shaft 62. When a desired current flows through the armature coil 59, the rotor 60 rotates by an electromagnetic induction action and the drive shaft 62 moves axially along with the rotor 60. In this manner, the bypass valve 56 operates to open and close the bypass passage 55.

Figure 6:
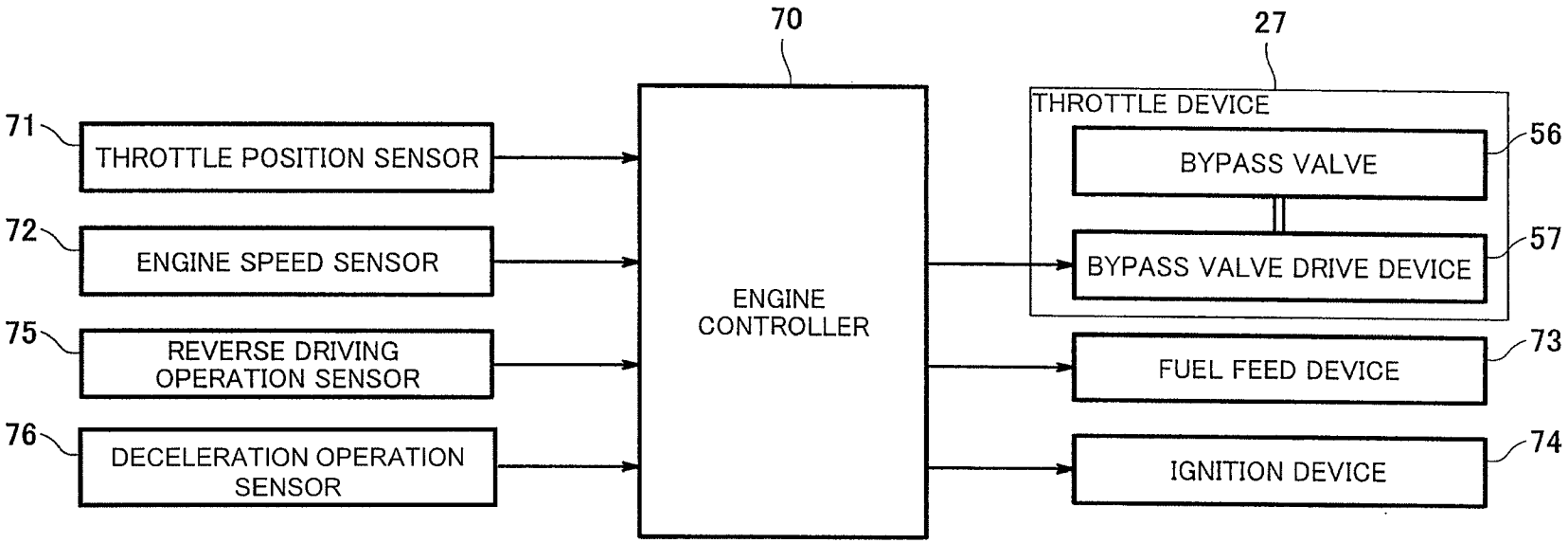
FIG. 6 is a block diagram showing a configuration of an engine controller built into the watercraft of FIG. 1.

FIG. 6 is a block diagram showing a configuration of the engine controller 70 built into the personal watercraft 1 of FIG. 1. Referring to FIG. 6, the engine controller 70 is communicatively coupled to a throttle position sensor 71 configured to detect an opening degree of the throttle valve 54, an engine speed sensor 72 configured to detect an engine speed, a bypass drive device 57 of the throttle device 27, a fuel feed device 73 configured to feed an amount of fuel to each cylinder, and an ignition device 74 configured to ignite an air-fuel mixture in each cylinder. The engine controller 70 is configured to control the devices 57, 73 and 74 based on the opening degree of the throttle valve 54 detected by the throttle position sensor 71 and the engine speed detected by the engine speed sensor 72. Thus, an air-intake amount, a fuel amount, and an ignition timing are adjusted, and the driving power and engine speed of the engine 6 are controlled.

Further, the engine controller 70 is communicatively coupled to a reverse driving operation sensor 75 configured to detect that the reverse driving operation member 33 is in the second position, and a deceleration operation sensor 76 configured to detect that the deceleration operation member 34 is in the second position. In this embodiment, the reverse driving operation member 33 and the deceleration operation member 34 are mechanically coupled to the reverse bucket 22 via the coupling mechanism 35 so that the position of the reverse bucket 22 is changed according to the position of the reverse driving operation member 33 and the position of the deceleration operation member 34. When the deceleration operation member 34 has reached the second position, the reverse bucket 22 has reached the deceleration position. Therefore, in this embodiment, the deceleration operation sensor 76 serves as a detector configured to detect whether or not the reverse bucket 22 has reached the deceleration position. Likewise, when the reverse driving operation member 33 has reached the second position, the reverse bucket 22 has reached the reverse driving position. Therefore, in this embodiment the reverse driving operation sensor 75 serves to detect whether or not the reverse bucket 22 has reached the reverse driving position.

Figure 7:
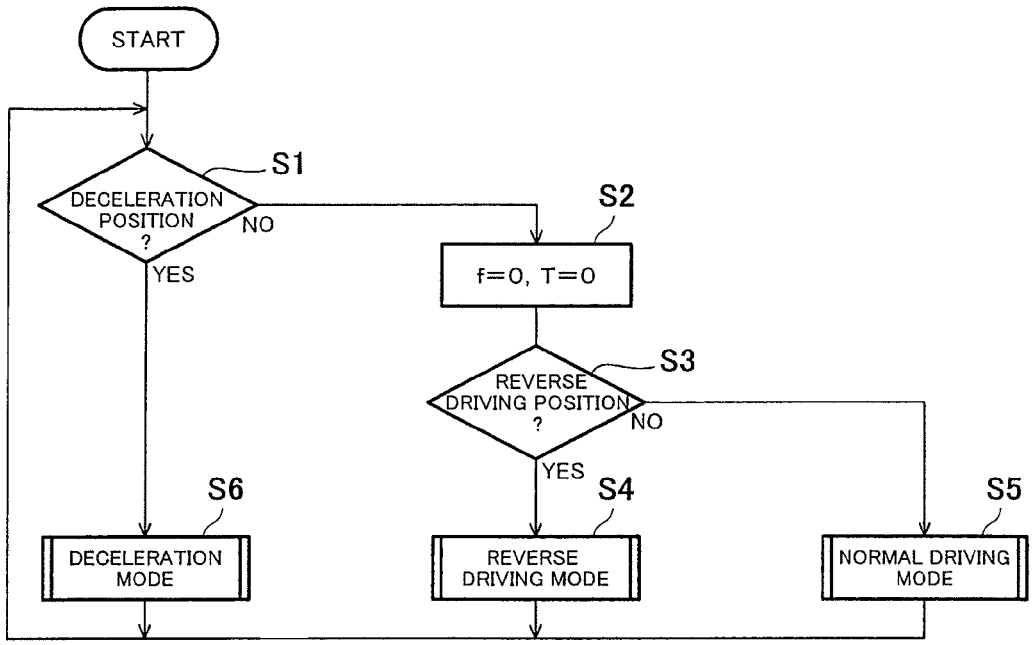
FIG. 7 is a flowchart showing a main flow of a control process executed by the engine controller of FIG. 6.
Figure 8:
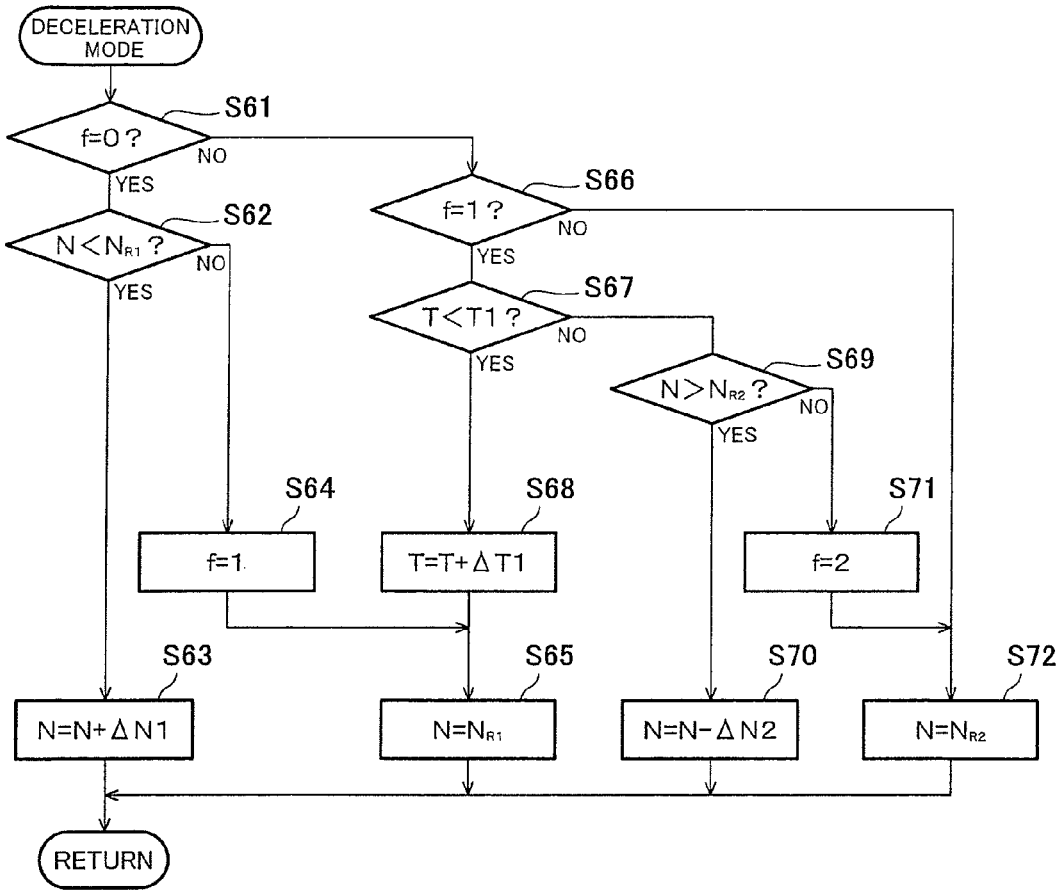
FIG. 8 is a flowchart showing a process in a deceleration mode shown in FIG. 7.

FIG. 7 is a flowchart showing a main flow of a control process executed by the engine controller 70 of FIG. 6. FIG. 8 is a flowchart showing the process in a deceleration mode shown in FIG. 7. A memory in the engine controller 70 is configured to store programs to be run to perform the process shown in FIGS. 7 and 8. A CPU of the engine controller 70 is configured to run the programs. The control starts after an ignition switch (not shown) is turned ON and a predetermined initialization process terminates.

Referring to FIG. 7, initially, it is determined whether or not the reverse bucket 22 is in the deceleration position (step S1). If it is determined that the reverse bucket 22 is not in the deceleration position (S1:NO), the process moves to step S2, and a flag value f and a timer value T are set to 0. The flag value f and the timer value T are used in the deceleration mode shown in FIG. 8 as described later. Then, it is determined whether or not the reverse bucket 22 is in the reverse driving position (step S3). If it is determined that the reverse bucket 22 is in the reverse driving position (S3:YES), the driving power of the engine 6 is controlled according to the reverse driving mode (step S4), and the process returns to step S1. If it is determined that the reverse bucket 22 is not in the reverse driving position (S3:NO), the driving power of the engine 6 is controlled according to a normal driving mode (step S5), and then the process returns to step S1. A method of controlling the driving power of the engine 6 in the reverse driving mode and the normal traveling mode are similar to those in a conventional method, and therefore, will not be described in detail.

If it is determined that the reverse bucket 22 is in the deceleration position (S1: YES), the driving power of the engine 6 and the engine speed N are controlled according to the deceleration mode (step S6), and then the process returns to step S1. In this embodiment, the position of the reverse bucket 22 is determined with reference to a signal output from the deceleration operation sensor 76 in step S1, and the position of the reverse bucket 22 is determined with reference to a signal output from the reverse driving operation sensor 75 in step S3.

Referring to FIG. 8, in the deceleration mode (S6), it is determined whether or not the flag value f is 0 (step S61). If it is determined that the flag value f is 0 (S61: YES), it is determined whether or not the engine speed N is lower than a first deceleration engine speed $N_{R1}$ (step S62). The value of the first deceleration engine speed $N_{R1}$ is larger than the value of an idling engine speed $N_1$. If it is determined that the engine speed N is lower than the first deceleration engine speed $N_{R1}$ (S62: YES), the bypass valve drive device 57 is controlled so that the opening degree of the bypass valve 56 increases to obtain an air-intake amount required to increase the engine speed N by a first predetermined value ΔN1 (step S63), and then the process returns to a main flow shown in FIG. 7.

If it is determined that the engine speed N is not lower than the first deceleration engine speed $N_{R1}$ (S62: NO), the flag value f is set to 1 (step S64). The bypass valve drive device 57 is controlled so that the opening degree of the bypass valve 56 is adjusted to obtain an air-intake amount required to maintain the engine speed N at the first deceleration engine speed $N_{R1}$ (step S65), and then the process returns to the main flow shown FIG. 7.

If it is determined that the flag value f is not 0 (S61: NO), it is determined whether or not the flag value f is 1 (step S66). If it is determined that the flag value f is 1 (S66: YES), it is determined whether or not a timer value T is smaller than a predetermined time period T1 (step S67). If it is determined that the timer value T is smaller than the predetermined time period T1 (S67: YES), the time value T is set to a value which is a sum of a current set value and a predetermined value ΔT1 (step S68). The process moves to step S65 and the opening degree of the bypass valve 56 is adjusted to obtain an air-intake amount required to maintain the engine speed N at the first deceleration engine speed $N_{R1}$. Then, the process returns to the main flow shown in FIG. 7.

If it is determined that the timer value T is not smaller than the predetermined time period T1 (step S67: NO), it is determined whether or not the engine speed N is higher than a second deceleration engine speed $N_{R2}$ (step S69). The value of the second deceleration engine speed $N_{R2}$ is smaller than the value of the first deceleration engine speed $N_{R1}$. If it is determined that the engine speed N is higher than the second deceleration engine speed $N_{R2}$ (S69: YES), the bypass valve drive device 57 is controlled so that the opening degree of the bypass valve 56 decreases to obtain an air-intake amount required to decrease the engine speed N by a second predetermined value ΔN2 (step S70). Then, the process returns to the main flow shown in FIG. 7.

If it is determined that the engine speed N is not higher than the second deceleration engine speed $N_{R2}$ (S69: NO), the flag value f is set to 2 (step S71). The bypass drive device 57 is controlled so that the opening degree of the bypass valve 56 is adjusted to obtain an air-intake amount required to maintain the engine speed N at the second deceleration engine speed $N_{R2}$ (step S72). Then, the process returns to the main flow shown in FIG. 7.

If it is determined that the flag value f is not 1 (in other words, the flag value f is 2) (S66:NO), the process moves to step S72, and the bypass valve drive device 57 is controlled to maintain the engine speed N at the second deceleration engine speed $N_{R2}$. Then, the process returns to the main flow shown in FIG. 7.

Figure 9:
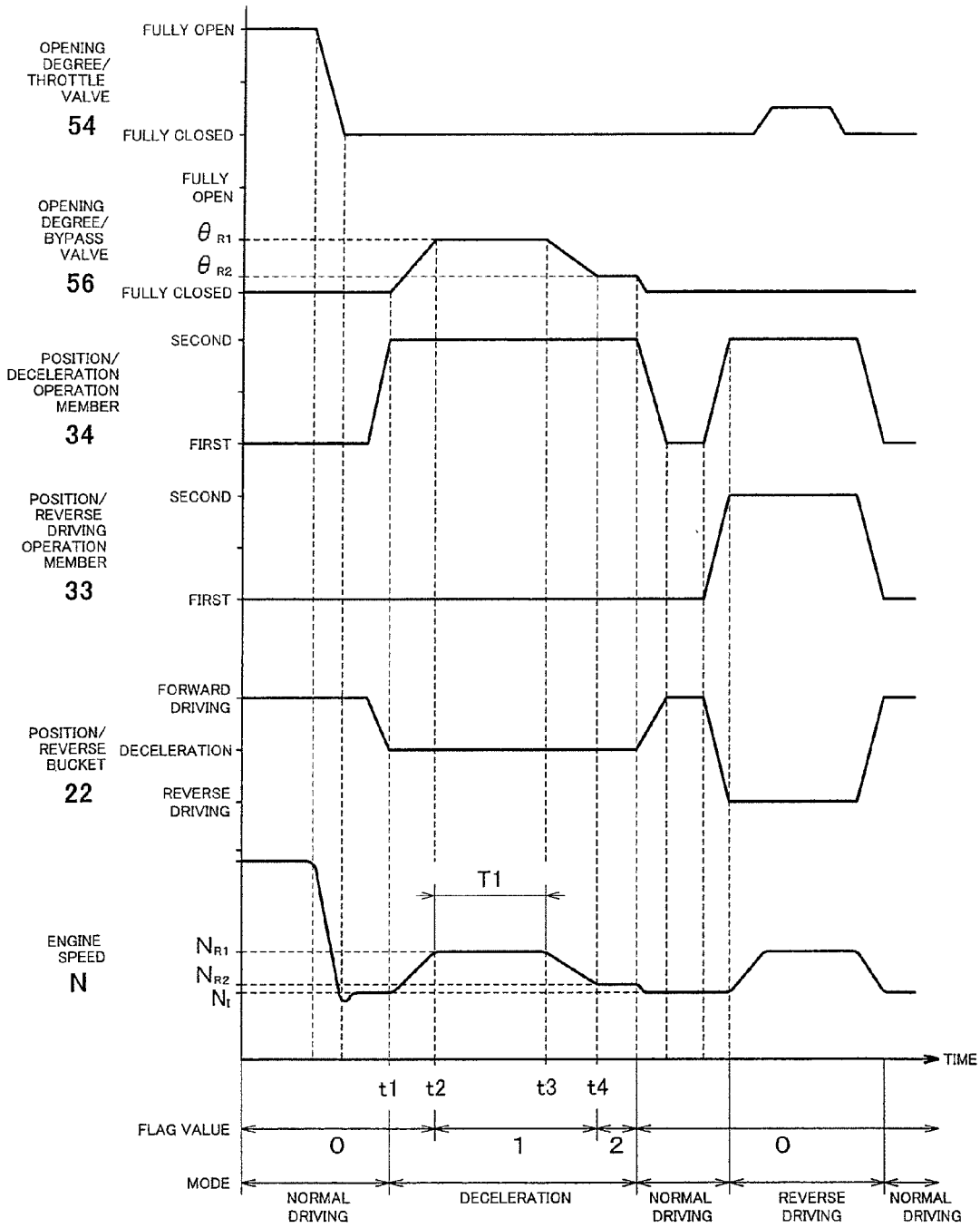
FIG. 9 is a timing chart showing an example of a change in an engine speed which occurs when the control process shown in FIGS. 7 and 8 is executed.

FIG. 9 is a timing chart showing an example of a change in the engine speed N which occurs when the control process shown in FIGS. 7 and 8 is executed. Referring to FIG. 9, when the reverse driving operation member 33 and the deceleration operation member 34 are not operated and are in the first position, the driving power of the engine 6 is controlled according to the normal driving mode (S5). In this case, if the throttle valve 54 is in a fully-open position, the engine speed N shifts to a high engine speed range. When the rider returns the driving power operation member 30 to the first position, the throttle valve 54 moves to the fully-closed position and the engine speed N decreases to the idling engine speed $N_I$.

In a case where the rider wishes to decelerate the watercraft 1 and operates the deceleration operation member 34, the normal driving mode transitions to the deceleration mode at time t1 when the deceleration operation member 34 has moved from the first position to the second position. Just after the time t1 when the deceleration mode starts, the flag value f is 0, and the engine speed N has decreased to the idling engine speed $N_I$ in the illustrated example. Therefore, step S61, step S62, step S63, and step S64 are sequentially performed. In other words, the engine speed N increases according to the first predetermined value ΔN1. For example, the engine controller may be configured to control the engine such that an engine speed reaches a set value higher than an idling engine speed regardless of an operation of the driving power operation member. With an increase in the engine speed N, the water jet being ejected from the water jet pump 10 increases in speed, and the additional decelerative effect produced by the resulting reaction of the water jet is enhanced.

At time t2 when the engine speed N has reached the first deceleration engine speed $N_{R1}$ which is higher than the idling engine speed $N_I$ set in the state where the deceleration operation member 34 is not operated, the flag value f is set to 1. Thereafter, step S61, step S66, step S67, step S68 and step S65 are sequentially performed during a predetermined time period T1. To be specific, during the predetermined time period T1, the opening degree of the bypass valve 56 is maintained at a first deceleration opening degree $\theta_{R1}$ which is larger than the fully-closed position, and the engine speed N is maintained at the first deceleration engine speed $N_{R1}$. In this state, the additional deceleration effect continues to be enhanced as described above.

After time t3 when the predetermined time T1 has lapsed, step S61, step S66, step S67, step S69 and step S70 are sequentially performed. That is, the engine speed N continues to decrease according to a second predetermined value ΔN 2. With a decrease in the engine speed N, the speed of the water jet being ejected from the water jet pump 10 gradually decreases, and the additional decelerative effect decreases. At time t4 when the engine speed N has reached the second deceleration engine speed $N_{R2}$, the flag value f is set to 2. Thereafter, step S61, step S66, and step S72 are sequentially performed. To be specific, the opening degree of the bypass valve 56 is maintained at a second deceleration opening degree $\theta_{R2}$ which is larger than the opening degree corresponding to the fully-closed position and is smaller than the first deceleration opening degree $\theta_{R1}$, and the engine speed N is maintained at the second deceleration engine speed $N_{R2}$.

As should be readily appreciated from the above, when the deceleration operation member 34 has been operated and the reverse driving operation member 33 is not operated, the bypass valve drive device 57 is controlled to open the bypass passage 55. In this way, the air-intake amount of the engine 6 can be ensured, in response to the rider's request for decelerating the watercraft 1, even when the driving power operation member 30 is in the first position and the throttle valve 54 is in the fully-closed position. This makes it possible to increase the speed of the water jet being ejected from the water jet pump 10. Therefore, the decelerative effect can be suitably produced using the reverse bucket 22.

Regarding an increase in the engine speed N just after time t1 and a decrease in the engine speed N just after time t3, a change rate of the increasing engine speed is set larger than a change rate of the decreasing engine speed when the engine speed N is changed in association with the operation of the deceleration operation member 34. To be specific, the first predetermined value ΔN1 in step S63 is set larger than the second predetermined value ΔN2 in step S70. This makes it possible to quickly enhance the additional decelerative effect just after the deceleration operation member 34 has been operated and to suitably avoid an undershooting phenomenon in which the engine speed N is lower than the suitable second deceleration engine speed $N_{R2}$.

The engine speed N is increased after the reverse bucket 22 has reached a predetermined deceleration position after the deceleration operation member 34 has been operated. For example, the engine controller may be configured to start controlling the engine to cause the engine speed to be higher than the idling engine speed after the movement detector detects that the reverse bucket has reached the deceleration position. This makes it possible to suitably avoid a problem caused by an increase in the speed of the water jet during the movement of the reverse bucket 22, for example, smooth movement of the reverse bucket 22 is impeded by the high-speed water jet.

FIGS. 7 to 9 show that the deceleration mode returns to the normal driving mode at time when the deceleration operation member 34 starts to return from the second position to the first position, and the normal driving mode transitions to the reverse driving mode at time when the reverse driving operation member 33 has been operated and has reached the second position. FIGS. 7 and 8 also show that the deceleration mode returns to the normal driving mode when the deceleration operation member 34 starts to return from the second position to the first position even when the flag value f is 0 or 1 in the deceleration mode. However, the conditions used to determine whether or not the deceleration mode should return to the normal driving mode and timing when the deceleration mode returns to the normal driving mode are not limited to those described above but may be suitably changed. Although in the example shown in FIGS. 8 and 9, the engine speed N is compared to the second deceleration engine speed $N_{R2}$ which is higher than the idling engine speed $N_1$ in step S69 and the set value of the engine speed N is set to the second deceleration engine speed $N_{R2}$ in step S72, they are merely exemplary. Any other suitable value may be used so long as the second deceleration engine speed $N_{R2}$ is different from the first deceleration engine speed $N_{R1}$.

Alternatively, regarding the control executed when the deceleration operation member 34 has been operated, the bypass drive device 57 may be controlled to increase the engine speed after a lapse of a predetermined time after the deceleration operation member 34 has been operated. The control for decreasing the increased engine speed is not necessarily performed. The second deceleration engine speed $N_{R2}$ may be higher than the first deceleration engine speed $N_{R1}$. Although the set value of the engine speed N is switched with reference to the timer value T, other driving parameter(s) may be used.

The deceleration engine speed may be a predetermined single constant value. The increase amount of the engine speed with respect to the idling engine speed may be suitably changed according to the driving state parameter such as a driving speed, and the deceleration engine speed may be suitably set and changed. In this case, the increase amount may be set to a larger value as the driving speed is higher. This can produce a higher deceleration effect as the driving speed is higher.

The three operation members 30, 33 and 34 are not necessarily lever-type operation members. For example, the reverse driving operation member 33 and the deceleration operation member 34 may be button-type members. Although the reverse driving operation member 33 and the deceleration operation member 34 may be positioned near the left grip 32 of the handle 20 to enable the rider to easily operate them while touching the left grip 32 to improve steering stability, they may be positioned anywhere else in the handle 20.

Although the deceleration operation sensor 76 may be configured to detect that the deceleration operation member 34 has reached the second position, it may be configured to detect whether or not the deceleration operation member 34 has been operated a predetermined amount or larger from the first position. The same may occur in the reverse driving operation sensor 75.

[Embodiment 2]

Figure 10:
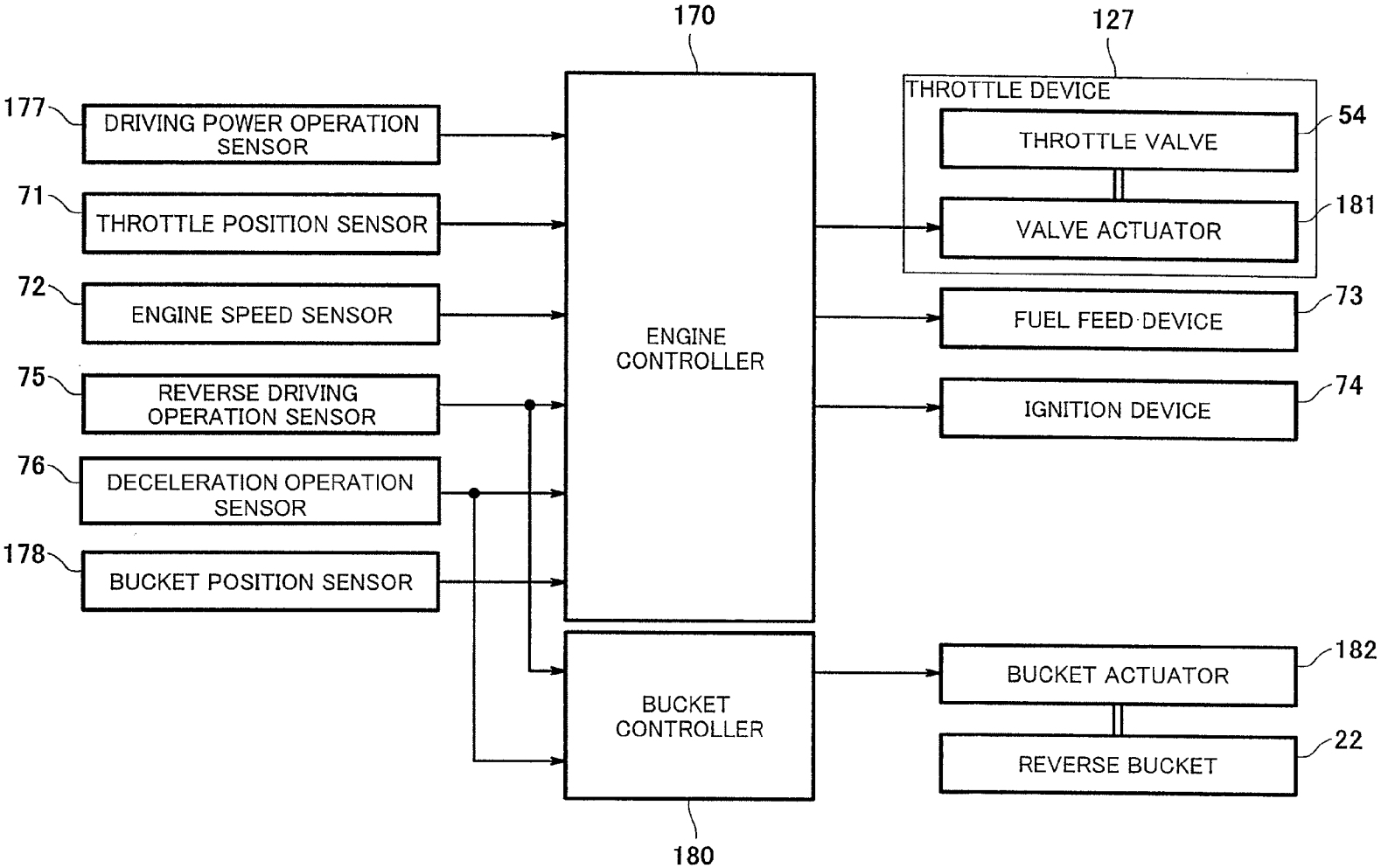
FIG. 10 is a block diagram showing a configuration of an engine controller and a bucket controller which are built into a personal watercraft according to Embodiment 2 of the present invention.

FIG. 10 is a block diagram showing a configuration of an engine controller 170 and others which are built into personal watercraft according to Embodiment 2 of the present invention. Embodiment 2 is different from Embodiment 1 in a configuration of the throttle device 127 and a driving method of the reverse bucket 22. In FIG. 10, the same reference numerals are used to designate the same or corresponding parts in Embodiment 1 and will not be described in detail.

The throttle device 127 of this embodiment shown in FIG. 10 does not include the idling control body 51, the bypass valve 56 and the bypass valve drive device 57 shown in FIG. 5, and the throttle cable 31 shown in FIG. 2. Instead, the throttle device 127 includes a valve actuator 181 configured to drive the throttle valve 54. The engine controller 170 is communicatively coupled to a driving power operation sensor 177 configured to detect the position of the driving power operation member 30 (see FIG. 2). The engine controller 170 is configured to set a target opening degree of the throttle valve 54 according to the position of the driving power operation member 30 which is detected by the driving power operation sensor 177 and control the valve actuator 181 so that an actual opening degree of the throttle valve 54 reaches the target opening degree.

The personal watercraft of Embodiment 2 does not include the coupling mechanism 35 shown in FIG. 2. Instead, the personal watercraft of Embodiment 2 includes a bucket actuator 182 configured to drive the reverse bucket 22 and a bucket controller 180 configured to control the bucket actuator 182. The bucket actuator 182 includes, for example, an electric motor or the like. The output shaft (not shown) of the bucket actuator 182 is coupled to the pivot shaft 25 shown in FIG. 1 to enable the pivot shaft 25 to rotate. The bucket controller 180 is communicatively coupled to the reverse driving operation sensor 75, the deceleration operation sensor 76 and a bucket position sensor 178 configured to detect the position of the reverse bucket 22. The bucket position sensor 178 is desirably configured to detect which position the reverse bucket 22 is within a pivot range. Nonetheless, the bucket position sensor 178 may be configured to detect at least whether or not the reverse bucket 22 is the deceleration position and at least whether or not the reverse bucket 22 is in the reverse driving position. In other words, the bucket position sensor 178 may be configured to detect whether or not the reverse bucket 22 has completely moved to the reverse driving position in response to the operation of the reverse driving operation member 33 and whether or not the reverse bucket 22 has completely moved to the deceleration position in response to the operation of the deceleration operation member 34.

Figure 11:
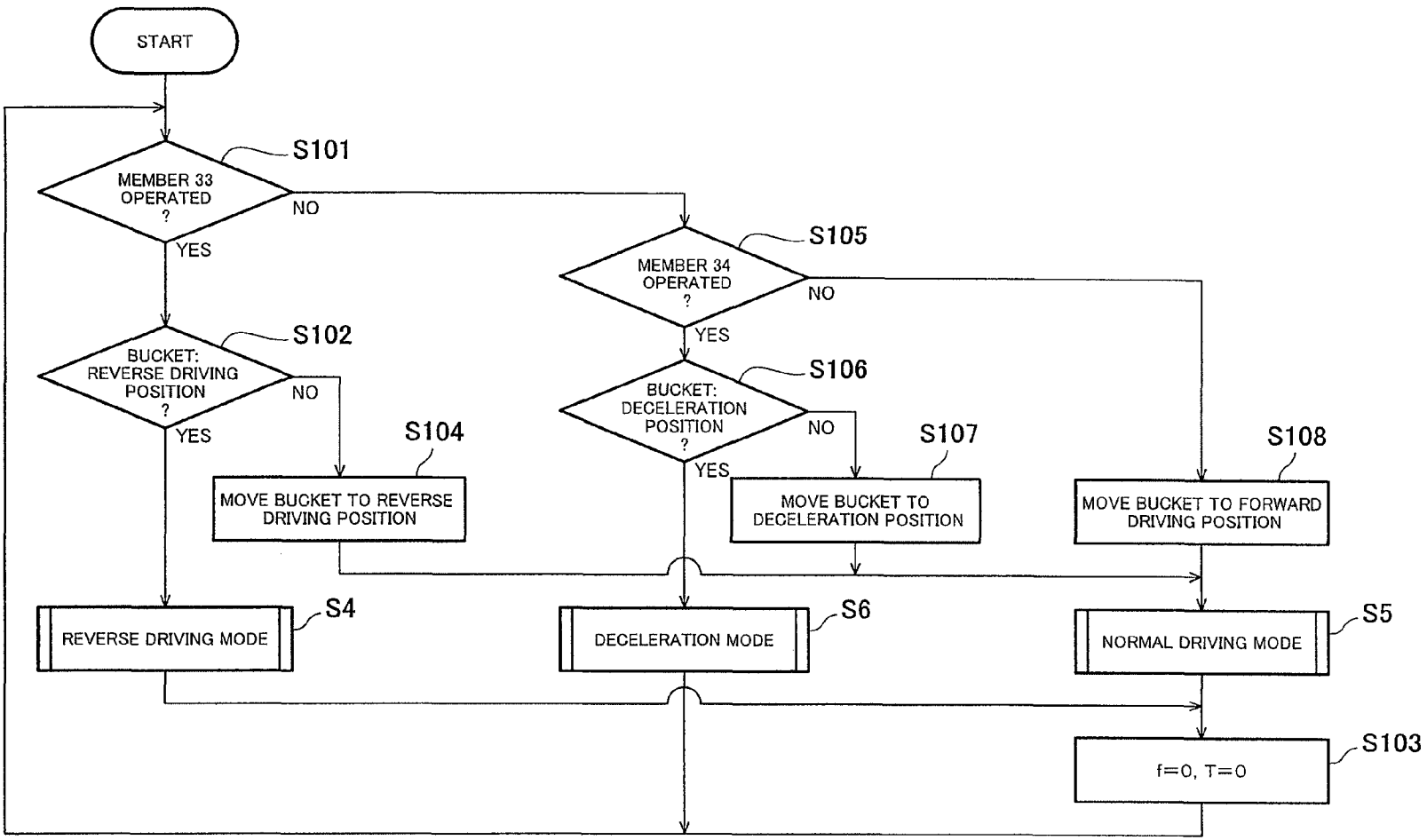
FIG. 11 is a flowchart showing a main flow of the control process executed by the engine controller and the bucket controller of FIG. 10.

FIG. 11 is a flowchart showing a main flow of the control process executed by the engine controller 170 and the bucket controller 180 of FIG. 10. Referring to FIG. 11, initially, it is determined whether or not the reverse driving operation member 33 has been operated (step S101). If it is determined that the reverse driving operation member 33 has been operated in step S101 (S101: YES), it is determined whether or not the reverse bucket 22 has reached the reverse driving position based on the detection value of the bucket position sensor 178 (step S102). If it is determined that the reverse bucket 22 has reached the reverse driving position (S102: YES), the driving power of the engine 6 is controlled according to the reverse driving mode as in Embodiment 1 (step S4), and the flag value f and the timer value T are set to 0 (step S103). Then, the process returns to step S101. If it is determined that the reverse bucket 22 has not reached the reverse driving position (S102: NO), the bucket actuator 182 is controlled to move the reverse bucket 22 toward the reverse driving position (step S104), and the driving power of the engine 6 is controlled according to the normal driving mode (step S5). Then, step S103 is performed and the process returns to step S101.

If it is determined that the reverse driving operation member 33 is not operated in step S101 (S101: NO), it is determined whether or not the deceleration operation member 34 has been operated (step S105). If it is determined that the deceleration operation member 34 has been operated (5105: YES), it is determined whether or not the reverse bucket 22 has reached the deceleration position based on the detection value of the bucket position sensor 178 (step S106). If it is determined that the reverse bucket 22 has reached the deceleration position (S106: YES), the driving power and engine speed of the engine 6 are controlled according to the deceleration mode as in Embodiment 1 (step S6), and then the process returns to step S101. If it is determined that the reverse bucket 22 has not reached the deceleration position (step S106: NO), the bucket actuator 182 is controlled to move the reverse bucket 22 toward the deceleration position (step S107), and step S5 and step S103 are performed as in the case where the reverse bucket 22 moves to the reverse driving position. Then, the process returns to step S101.

If it is determined that the deceleration operation member 34 is not operated in step S105 (S105: NO), the bucket actuator 182 is controlled to move the reverse bucket 22 to the forward driving position (step S108), and step S5 and step S103 are performed as in the above case. Thus, the process terminates.

In Embodiment 2, also, when the normal driving mode transitions to the deceleration mode (S6), the control process is executed along the flow shown in FIG. 8. In step S63, step S65, step S70 and step S72, the engine speed N is controlled to reach a suitable set value in such a manner that the valve actuator 181 is controlled to control the opening degree of the throttle valve 54. When the control process is executed along the flow shown in FIG. 11, the additional decelerative effect is also enhanced when the deceleration operation member 34 is operated as in Embodiment 1.

The personal watercraft of the present invention may be configured to include the throttle device 127 of Embodiment 1 and the electric reverse bucket 22 of Embodiment 2. Alternatively, the personal watercraft of the present invention may be configured to include the throttle device 127 of Embodiment 2 and the wire-driven reverse bucket 22 of Embodiment 1.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

an engine mounted in a body;

a water jet pump configured to be driven by the engine to generate a water jet to apply a propulsive force to the body;

a reverse bucket mounted at a periphery of the water jet pump and movable between a forward driving position and a reverse driving position, the reverse bucket being configured to permit the water jet to be directed rearwardly in the forward driving position and to direct the water jet in a forward direction in the reverse driving position;

a driving power operation member configured to be operated by a rider to control a driving power of the engine;

a reverse driving operation member configured to be operated by the rider to change a position of the reverse bucket from the forward driving position to the reverse driving position; and a deceleration operation member provided separately from the reverse driving operation member and configured to be operated by the rider to change a position of the reverse bucket;

wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated.

2. The personal watercraft according to claim 1, further comprising:

a pair of right and left grips which are gripped by the rider;

wherein the reverse driving operation member and the deceleration operation member are attached to one of the right and left grips.

3. A personal watercraft comprising:

an engine mounted in a body;

a water jet pump configured to be driven by the engine to generate a water jet to apply a propulsive force to the body;

a reverse bucket mounted at a periphery of the water jet pump and movable between a forward driving position and a reverse driving position, the reverse bucket being configured to permit the water jet to be directed rearwardly in the forward driving position and to direct the water jet in a forward direction in the reverse driving position;

a driving power operation member configured to be operated by a rider to control a driving power of the engine;

a reverse driving operation member configured to be operated by the rider to change a position of the reverse bucket from the forward driving position to the reverse driving position; and a deceleration operation member configured to be operated by the rider;

wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated, the personal watercraft further comprising:

a deceleration operation detector configured to detect whether or not the deceleration operation member has been operated; and an engine controller configured to control an operation of the engine;

wherein the engine controller is configured to control the engine such that an engine speed is higher when the deceleration operation detector detects that the deceleration operation member has been operated than when the deceleration operation detector detects that the deceleration operation member is not operated.

4. The personal watercraft according to claim 3, further comprising:

a throttle valve configured to open and close an air-intake passage of the engine according to an operation amount of the driving power operation member;

a bypass passage connected to the air-intake passage such that air flowing in the air-intake passage bypasses the throttle valve;

a bypass valve configured to open and close the bypass passage; and a bypass valve drive device configured to drive the bypass valve;

wherein the engine controller is configured to control the bypass valve drive device such that an opening degree of the bypass valve is larger when the deceleration operation detector detects that the deceleration operation member has been operated than when the deceleration operation detector detects that the deceleration operation member is not operated.

5. A personal watercraft comprising:

an engine mounted in a body;

a water jet pump configured to be driven by the engine to generate a water jet to apply a propulsive force to the body;

a reverse bucket mounted at a periphery of the water jet pump and movable between a forward driving position and a reverse driving position, the reverse bucket being configured to permit the water jet to be directed rearwardly in the forward driving position and to direct the water jet in a forward direction in the reverse driving position;

a driving power operation member configured to be operated by a rider to control a driving power of the engine;

a reverse driving operation member configured to be operated by the rider to change a position of the reverse bucket from the forward driving position to the reverse driving position; and a deceleration operation member configured to be operated by the rider;

wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated, the personal watercraft further comprising:

a deceleration operation detector configured to detect whether or not the deceleration operation member has been operated; and an engine controller configured to control an operation of the engine;

wherein the engine controller is configured to control the engine such that an engine speed is higher than an idling engine speed when the deceleration operation detector detects that the deceleration operation member has been operated.

6. The personal watercraft according to claim 5, further comprising:

a throttle valve configured to open and close an air-intake passage of the engine; and a valve actuator configured to drive the throttle valve;

wherein the engine controller is configured to control the engine such that an engine speed reaches a set value higher than an idling engine speed regardless of an operation of the driving power operation member, when the deceleration operation detector detects that the deceleration operation member has been operated.

7. The personal watercraft according to claim 5, further comprising:

a movement detector configured to detect whether or not the reverse bucket has reached a deceleration position;

wherein the engine controller is configured to start controlling the engine to cause the engine speed to be higher than the idling engine speed after the movement detector detects that the reverse bucket has reached the deceleration position.

8. The personal watercraft according to claim 5, wherein the engine controller is configured to control the engine such that the engine speed reaches a first set value higher than the idling engine speed after the deceleration operation detector detects that the deceleration operation member has been operated, and to then control the engine such that the engine speed reaches a second set value which is different from the first set value.

9. The personal watercraft according to claim 5, wherein the engine controller is configured to control the engine such that the engine speed reaches a set value higher than an idling engine speed after the deceleration operation detector detects that the deceleration operation member has been operated, and wherein the engine controller is configured to determine the set value based on a driving state parameter.

10. A personal watercraft comprising:

an engine mounted in a body;

a water jet pump configured to be driven by the engine to generate a water jet to apply a propulsive force to the body;

a reverse bucket mounted at a periphery of the water jet pump and movable between a forward driving position and a reverse driving position, the reverse bucket being configured to permit the water jet to be directed rearwardly in the forward driving position and to direct the water jet in a forward direction in the reverse driving position;

a driving power operation member configured to be operated by a rider to control a driving power of the engine;

a reverse driving operation member configured to be operated by the rider to change a position of the reverse bucket from the forward driving position to the reverse driving position; and a deceleration operation member configured to be operated by the rider;

wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated, the personal watercraft further comprising:

a reverse driving operation detector configured to detect whether or not the reverse driving operation member has been operated;

a deceleration operation detector configured to detect whether or not the deceleration operation member has been operated;

a bucket actuator configured to drive the reverse bucket; and a bucket controller configured to control an operation of the bucket actuator;

wherein the bucket controller is configured to control the operation of the bucket actuator to cause the reverse bucket to be in the forward driving position when the reverse driving operation detector detects that the reverse driving operation member is not operated and the deceleration operation detector detects that the deceleration operation member is not operated;

wherein the bucket controller is configured to control the operation of the bucket actuator to cause the reverse bucket to be in the deceleration position when the reverse driving operation detector detects that the reverse driving operation member is not operated and the deceleration operation detector detects that the deceleration operation member has been operated; and wherein the bucket controller is configured to control the operation of the bucket actuator to cause the reverse bucket to be in the reverse driving position when the reverse driving operation detector detects that the reverse driving operation member has been operated.

11. A personal watercraft comprising:

an engine mounted in a body;

a water jet pump configured to be driven by the engine to generate a water jet to apply a propulsive force to the body;

a reverse bucket mounted at a periphery of the water jet pump and movable between a forward driving position and a reverse driving position, the reverse bucket being configured to permit the water jet to be directed rearwardly in the forward driving position and to direct the water jet in a forward direction in the reverse driving position;

a driving power operation member configured to be operated by a rider to control a driving power of the engine;

a reverse driving operation member configured to be operated by the rider to change a position of the reverse bucket from the forward driving position to the reverse driving position; and a deceleration operation member configured to be operated by the rider;

wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated, the personal watercraft further comprising:

a first wire configured to mechanically couple the reverse driving operation member to the reverse bucket;

a second wire configured to mechanically couple the deceleration operation member to the reverse bucket; and a biasing member configured to apply a force to place the reverse bucket in the forward driving position;

wherein the reverse bucket is in the forward driving position when the reverse driving operation member and the deceleration operation member are not operated;

wherein the reverse bucket is pulled by at least the second wire and moves to the deceleration position, in response to the operation of the deceleration operation member against the force applied by the biasing member; and wherein the reverse bucket is pulled by at least the first wire and moves to the reverse driving position, in response to the operation of the reverse driving operation member against the force applied by the biasing member.

12. A personal watercraft comprising:

an engine mounted in a body;

a water jet pump configured to be driven by the engine to generate a water jet to apply a propulsive force to the body;

a reverse bucket mounted at a periphery of the water jet pump and movable between a forward driving position and a reverse driving position, the reverse bucket being configured to permit the water jet to be directed rearwardly in the forward driving position and to direct the water jet in a forward direction in the reverse driving position;

a driving power operation member configured to be operated by a rider to control a driving power of the engine;

a reverse driving operation member configured to be operated by the rider to change a position of the reverse bucket from the forward driving position to the reverse driving position; and a deceleration operation member configured to be operated by the rider;

wherein the reverse bucket is in the forward driving position when the deceleration operation member and the reverse driving operation member are not operated; and wherein the reverse bucket is in a deceleration position between the forward driving position and the reverse driving position when the deceleration operation member has been operated and the reverse driving operation member is not operated, the personal watercraft further comprising:

a pair of right and left grips which are gripped by the rider;

wherein the reverse driving operation member and the deceleration operation member are pivotally attached on one of the pair of right and left grips;

wherein the deceleration operation member is a deceleration operation lever positioned in front of and adjacent to the one of the grips; and the reverse driving operation member is a reverse driving operation lever positioned in front of and adjacent to the deceleration operation lever.

13. The personal watercraft according to claim 12, further comprising:

a common pivot to which one end portion of the reverse driving operation lever is attached such that the reverse driving operation lever is pivotable around the common pivot and to which one end portion of the deceleration operation lever is attached such that the deceleration operation lever is pivotable around the common pivot;

wherein the reverse driving operation lever is shorter than the deceleration operation lever.

14. The personal watercraft according to claim 12, wherein the reverse driving operation lever and the deceleration operation lever are pivotable within a substantially same flat plane.

* * * * *